United States Patent [19]

Suzuki et al.

[11] Patent Number: 4,463,783

[45] Date of Patent: Aug. 7, 1984

[54] METHOD OF INSERTING THE WEFT IN JET LOOM

[75] Inventors: Hajime Suzuki, Anjo; Kinpei Mitsuya, Aichi, both of Japan

[73] Assignee: Seisakusho Kabushiki Kaisha Toyoda Jidoshokki, Kariya, Japan

[21] Appl. No.: 475,512

[22] Filed: Mar. 15, 1983

[30] Foreign Application Priority Data

Mar. 19, 1982 [JP] Japan ..... 57-45213

[51] Int. Cl.[3] ..... D03D 47/30

[52] U.S. Cl. ..... 139/435; 139/1 R

[58] Field of Search ..... 139/1 R, 435; 226/97

[56] References Cited

FOREIGN PATENT DOCUMENTS 2065726 7/1981 United Kingdom ..... 139/1 R

*Primary Examiner*—Henry Jaudon

*Attorney, Agent, or Firm*—Brooks, Haidt, Haffner & Delahunty

[57] ABSTRACT

In a jet loom in which a weft yarn is inserted through the warp shed by a jet of fluid such as air, the thickness of the weft yarn is detected prior to insertion continuously or at intervals with a yarn thickness detector, and the pressure of ejection of the fluid jet is controlled by a result of such detection so as to be optimum for the weft insertion. The jet of fluid is ejected from a nozzle member under the controlled pressure to insert the weft yarn reliably without insertion failures.

11 Claims, 1 Drawing Figure

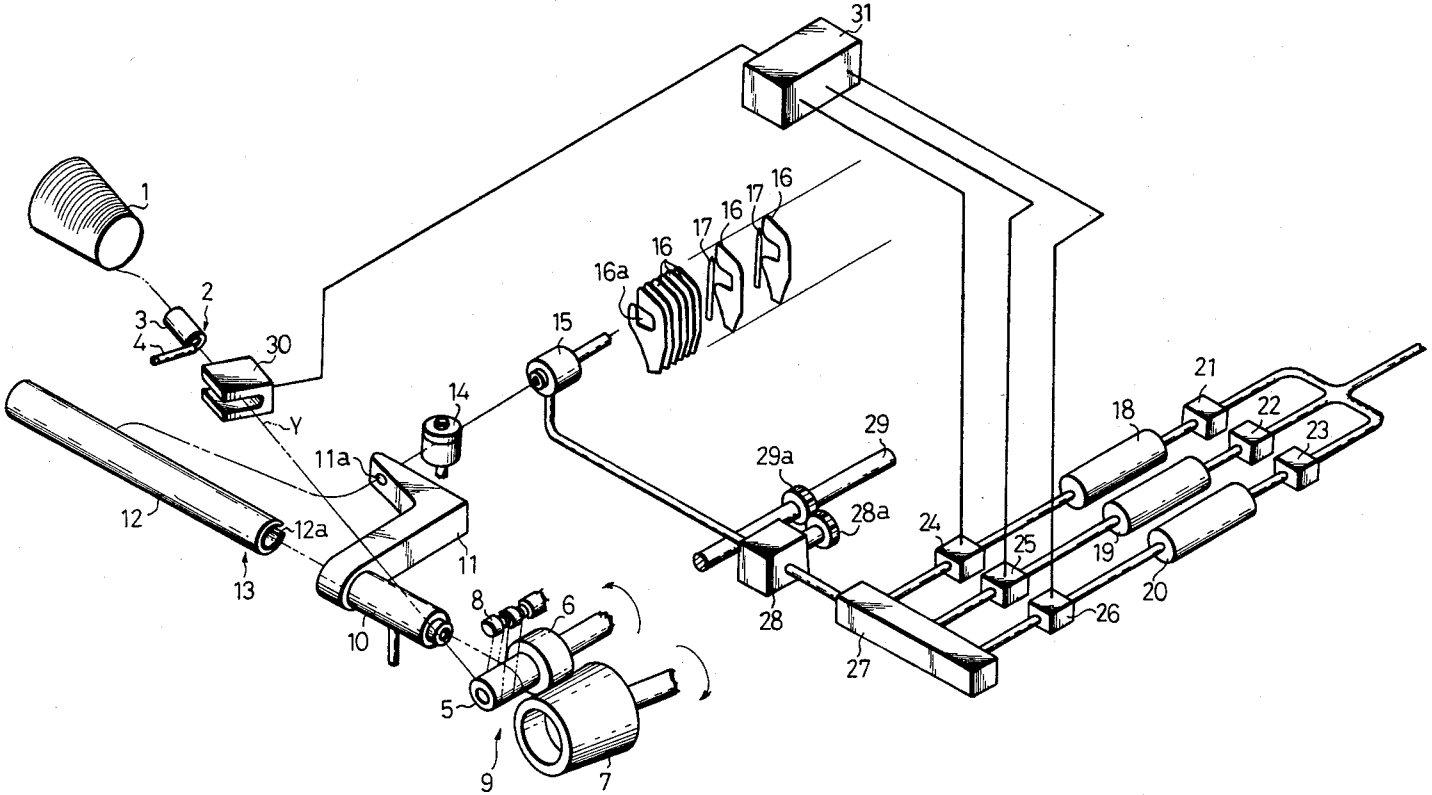
1
2
3
4
5
6
7
8
9
10
11
11a
12
12a
13
14
15
16
16a
17
18
19
20
21
22
23
24
25
26
27
28
28a
29
29a
30
31
Y

METHOD OF INSERTING THE WEFT IN JET LOOM

BACKGROUND OF THE INVENTION

1. Field of the Invention

The present invention relates to a method of inserting the weft yarn in a jet loom.

2. Description of the Prior Art

There are known jet looms in which the weft thread is carried through the warp shed by a jet of fluid such as air. It is important in such jet looms that the weft taken by the fluid jet reaches the opposite selvage of a fabric being woven reliably without being broken. If the weft insertion were not carried out properly, the fabric being woven would suffer from defects and undesirable fabric could be produced.

It has been customary practice in jet looms to eject a jet of air or liquid under a constant pressure at all times for inserting the weft thread through the warp shed. The prior method is disadvantageous in that a weft yarn thinner than the normal weft yarn would tend to be broken due to the fluid pressure being too strong for the thinner weft yarn, and a weft yarn thicker than the normal weft yarn would be liable to terminate short of the opposite selvage during weft insertion as the fluid pressure is too weak for the thicker weft yarn.

SUMMARY OF THE INVENTION

It is an object of the present invention to provide a method of inserting a weft thread in a jet loom by a jet of fluid ejected under a pressure control dependent on the thickness of the weft thread to be inserted, to thereby prevent weft insertion failures.

Another object of the present invention is to provide a method of inserting a weft thread in a jet loom by a jet of fluid ejected from a main nozzle under a pressure which can be kept at a preset level at all times without being subjected to a pressure drop.

Still another object to the present invention is to provide a method of reliably inserting a weft thread on a jet loom by controlling the pressure of a jet of fluid ejected from a main nozzle and also the pressure of jets of fluid ejected from a plurality of auxiliary nozzles.

According to the present invention, the thickness of a weft yarn to be inserted through a warp shed in a jet loom is detected prior to insertion continuously or at intervals with a yarn thickness detector, and the pressure of ejection of a fluid such as air is controlled so as to be optimum for inserting the weft yarn with an ejection pressure control mechanism based on the result of detection of the thickness of the weft yarn. The fluid is then ejected through a nozzle under the controlled pressure for inserting the weft yarn through the warp shed.

The above and other objects, features and advantages of the present invention will become more apparent from the following description when taken in conjunction with the accompanying drawing in which a preferred embodiment of the present invention is shown by way of illustrative example.

BRIEF DESCRIPTION OF THE DRAWING

The sole FIGURE is an exploded perspective view of an assembly for carrying out a method according to an embodiment of the present invention.

DETAILED DESCRIPTION OF THE PREFERRED EMBODIMENT

As shown in the sole FIGURE, a weft tensioning unit 2 comprises a cylindrical yarn guide tube 3 for insertion therethrough of a weft yarn Y supplied from a weft supply package 1, and a nozzle 4 for injecting a jet of fluid such as air into the yarn guide tube 3 in a direction opposite to that of travel of the weft yarn Y, for thereby tensioning the latter.

A weft length measuring unit 9 is composed of a length measuring roller 5, a driven roller 6 mounted coaxially on the length measuring roller 5, a drive roller 7 having a tapered peripheral surface held in rolling contact with the driven roller 6 for rotating the latter at a uniform speed, and a fixed yarn guide 8 spaced upwardly from the length measuring roller 5.

A weft yarn storage unit 13 has a nozzle 10, a bracket 11 secured to the nozzle 10 and having a guide hole **11*a* for guiding the weft yarn Y therethrough, and a weft yarn storage pipe 12 having a longitudinal slit 12*a*** defined therein and extending the entire axial length thereof.

The weft yarn Y as it emerges from the guide hole **11*a* is selectively gripped by a gripper 14 which is openable and closable in synchronism with weft inserting operation. After leaving the gripper 14, the weft yarn Y is carried by a jet of fluid such as air ejected from a main jet nozzle 15. A multiplicity of guide members 16 are positioned upwardly of a sley (not shown) and arranged in juxtaposed relation in the direction in which the weft yarn Y is inserted through the warp shed. The guide members 16 jointly define a guide passage 16*a* for guiding therethrough the fluid jet ejected by the main nozzle 15. The weft yarn Y after being unwound from the weft supply package 1 is fed through the yarn guide tube 3, the length measuring roller 5, the fixed guide 8, the length measuring guide 5 again, the nozzle 10, the weft yarn storage pipe 12, the guide hole 11*a*, and thence through the gripper 14 to the main jet nozzle 15, by which the weft yarn Y is taken through the guide passage 16*a*** on the fluid jet.

A plurality of auxiliary jet nozzles 17 are disposed at the proper intervals to confront the opening the guide passage **16*a* for assisting the weft yarn Y being inserted in travelling through the guide passage 16*a***.

The fluid to be ejected from the main jet nozzle 15 is supplied by first, second and third reservoir tanks 18, 19, 20 kept under internal pressures P1, P2, P3, respectively, that have the relationship: $P1>P2>P3$. The pressure P2 is selected to be most effective in inserting a weft yarn Y having a prescribed thickness, and is normally employed for weft insertion. The pressure P1 is set so as to be optimum for inserting a weft yarn of a thickness larger than the prescribed thickness, whereas the pressure P3 is selected to be suitable for inserting a weft yarn having a thickness smaller than the prescribed thickness.

The reservoir tanks 18, 19, 20 are connected to a fluid source (not shown) via first, second and third pressure regulators 21, 22, 23, respectively. When the actual pressures within the tanks 18, 19, 20 are reduced to below the present pressures P1, P2, P3, respectively, the pressure regulators 21, 22, 23 detect such pressure drops and supply the tanks 18, 19, 20 with the fluid from the fluid source, which has an internal pressure higher than the pressure P1. The supply of the fluid is stopped when the pressures in the tanks 18, 19, 20 reach the above preset pressures.

First, second and third solenoid-operated valves 24, 25, 26 are held in fluid communication with the reservoir tanks 18, 19, 20, respectively. The solenoid-operated valves 24, 25, 26 can be actuated in synchronism with the weft inserting operation under commands issued from an ejection pressure control device 31 for supplying the fluid from the tanks 18, 19, 20 to the main nozzle 15.

The solenoid-operated valves 24, 25, 26 communicate through a common fluid guide 27 and a main valve 28 with the main nozzle 15. The main valve 28 has a gear 28*a* meshing with a gear 29*a* fixed to a drive shaft 29 rotatably supported on and extending between the side frames of a loom (not illustrated). The main valve 28 is actuated by rotation of the drive shaft 29 for supplying the fluid from the common fluid guide 27 to the main nozzle 15 in synchronism with the weft inserting operation.

A yarn thickness detector 30 is disposed between the weft tensioning unit 2 and the weft length measuring unit 9 for detecting thicknesses of the weft yarn Y as unwound off the package 1 and converting the detected yarn thicknesses into electric signals (such as voltages) proportional to the thicknesses of the weft yarn Y.

The ejection pressure control device 31 is electrically connected to the yarn thickness detector 30 and to the first, second and third solenoid-operated valves 24, 25, 26. The ejection pressure control device 31 is responsive to electrical signals fed from the yarn thickness detector 30 for calculating the mean value of those electric signals which correspond to varying thicknesses of the weft yarn Y readied for insertion and for actuating one of the first, second and third solenoid-operated valves 24, 25, 26 dependent on the calculated mean value in synchronism with the insertion of the weft yarn Y. Specifically, the ejection pressure control device 31 will actuate the second solenoid-operated valve 25 to supply the fluid from the reservoir tank 19 to the main nozzle under the pressure P2 when the mean value of the varying thicknesses of the weft yarn Y falls within a predetermined range (a desired range including the preset thickness of the weft yarn Y). In case the mean value of the yarn thicknesses is below the predetermined range, the third solenoid-operated valve 26 is actuated by the ejection pressure control device 31 to supply the fluid from the third reservoir tank 20 to the main nozzle 15 under the pressure P3. Conversely, where the mean value of the yarn thicknesses exceeds the predetermined range, the first solenoid-operated valve 24 is actuated by the ejection pressure control device 31 to supply the fluid from the first reservoir tank 18 to the main nozzle 15 under the pressure P1.

The assembly of the foregoing construction will operate as follows:

The weft yarn Y is supplied from the weft supply package 1 and tensioned by the weft tensioning unit 2. The weft yarn Y runs from the package 1 to the weft length measuring unit 9 at a uniform rate as the weft yarn Y is measured continuously by the length measuring roller 5 that rotates at a uniform speed. The yarn thickness detector 30 continuously detects varying thicknesses of the weft yarn Y as it travels therethrough at the uniform rate, and delivers electric signals representative of the detected yarn thicknesses to the ejection pressure control device 31. When a prescribed length of the weft yarn Y is stored in the weft yarn storage unit 13, the yarn inserting operation is now ready to start. At this time, the ejection pressure control device 31 calculates the mean value of electric signals corresponding to the mean value of thicknesses of the weft yarn Y based on electric signals picked up from the length of the weft yarn Y readied for insertion (equal to the weft length extending substantially from the weft length measuring unit 9 to the main jet nozzle 15).

When the mean value of the thicknesses of the weft yarn Y is in the predetermined range (including the preset thickness of the weft yarn Y), the ejection pressure control device 31 actuates the second solenoid-operated valve 25. At the same time, the main valve 28 is actuated and the gripper 14 is opened to release the weft yarn Y. The fluid supplied from the second reservoir tank 19 under the pressure P2 flows through the second solenoid-operated valve 25, the common fluid guide 27 and the main valve 28 and is ejected from the main jet nozzle 15. The weft yarn Y is now carried by the ejected fluid so as to be inserted through the guide passage 16*a*. When the weft yarn Y has been inserted, the second solenoid-operated valve 25 and the main valve 28 are inactivated to interrupt the supply of the fluid to the main jet nozzle 15, and the gripper 14 is closed to clamp the yarn Y again.

In case the mean value of the thicknesses of the weft yarn Y to be inserted is smaller than the predetermined range, the ejection pressure control device 31 actuates the third solenoid-operated valve 26 to allow the fluid to be supplied from the third reservoir tank 20 to the main jet nozzle 15 under the pressure P3. When the mean value of the thicknesses of the weft yarn Y is greater than the predetermined range, the first solenoid-operated valve 24 is actuated to permit the fluid to be supplied from the first reservoir tank 18 to the main jet nozzle 15 under the pressure P1.

Accordingly, when a weft yarn Y substantially as thick as the preset thickness is to be inserted, the normal ejection pressure P2 is employed. When a weft yarn Y thinner than the normal weft yarn is to be inserted, the ejection pressure P3 smaller than the ejection pressure P2 is utilized. For inserting a weft yarn Y thicker than the normal weft yarn, the ejection pressure P1 higher than the ejection pressure P2 is utilized.

As a consequence, the fluid jet is ejected under the pressure automatically adjustable to a particular weft yarn to be inserted. Since a thinner-than-normal weft yarn Y is carried by a fluid jet ejected under the pressure optimum for that weft yarn Y, there is no danger for the weft yarn Y to be broken or cut off by too high a fluid jet pressure. Similarly, a thicker-than-normal weft yarn Y is inserted by a fluid jet discharged under the pressure suitable to the thicker weft yarn Y, so that the latter can reach the opposite selvedge without fail.

In principle, the first, second and third reservoir tanks 18, 19, 20 may be dispensed with, and the first, second and third pressure regulators 21, 22, 23 alone can produce the plurality of different pressures P1, P2, P3. However, the pressure regulators 21, 22, 23 are subjected to a delay in their response when detecting a pressure drop in the main jet nozzle 15 and supplying the fluid to the latter, resulting in the risk of inducing a drop in the pressure at which the fluid is ejected from the main jet nozzle 15. To prevent this difficulty, it is better to provide the first, second and third reservoir tanks 18, 19, 20 for allowing the ejection pressure to reach the prescribed pressure immediately should any pressure drop occur in the main jet nozzle 15.

The present invention should not be interpreted as being limited to the foregoing illustrated embodiment, but may be embodied as follows:

1. An ejection pressure control device may be used which issues a command signal in response to a maximum and/or minimum value of thicknesses of a length of the weft yarn Y which is to be inserted in a single cycle of weft insertion;

2. A single pressure regulator may be employed which is operated by a command from the ejection pressure control device for effecting the nonstep continuous control of the pressure of a fluid supplied from the fluid source until an ejection pressure optimum for the thickness of a weft yarn to be inserted can be reached. Such a pressure regulator may be composed of a solenoid energized by the magnitude of a command signal delivered from the ejection pressure control device for controlling the cross-sectional area of a passage through which the fluid flows, or may comprise a rod having a hole for passage therethrough of the fluid and controllable in its axial angular displacement based on the magnitude of a command signal for controlling the cross-sectional area of the passage of the fluid;

3. In addition to the control of the ejection pressure at the main jet nozzle 15, the ejection pressure of a fluid discharged from the auxiliary nozzles 17 may also be controlled;

4. The yarn thickness detector 30 may be changed in position (e.g., displaced toward the weft supply package 1) so that a length of the weft yarn Y to be consumed in one cycle of weft insertion will be detected for its thicknesses and be readied for weft insertion after previous one or more lengths of weft have been inserted;

5. Four or more reservoir tanks with different internal pressures may be used (with the pressures including a pressure optimum for carrying a weft yarn of normal thickness, and pressures higher and lower than the optimum pressure);

6. The weft yarn Y may be detected for its thicknesses continuously or at intervals through a plurality of weft insertion cycles, and the results of such thickness detection may be statistically analyzed for controlling the ejection pressure of the fluid in following weft insertion cycles; and 7. The yarn thickness detector 30 may be disposed between the weft length measuring unit 9 and the weft yarn storage unit 13.

Furthermore, the operating time of the solenoid-operated valves may be controlled on the basis of the thickness of a weft yarn such that the main jet nozzle and/or auxiliary jet nozzles will eject the fluid for a longer period of time when the weft yarn is thicker than a normal weft yarn, and the main jet nozzle and/or auxiliary jet nozzles will eject the fluid for a shorter period of time when the weft yarn is thinner than a normal weft yarn.

Based on the thickness of a weft yarn to be inserted, the auxiliary nozzles 17 positioned between the guide members 16 may be selectively actuated to provide an additional ejection pressure optimum for the weft yarn.

With the present invention, as described above, the thickness of a weft yarn is detected and the result of such detection is utilized to control the ejection pressure of a fluid ejected for carrying the weft thread through the warp shed in a jet loom without weft insertion failures.

Although a certain preferred embodiment has been shown and described, it should be understood that the present invention should not be limited to the specific embodiment described, and many changes and modifications may be made therein without departing from the scope of the appended claims.

What is claimed is:

1. A method of inserting a weft yarn in a jet loom, comprising the steps of:

(a) detecting the thickness of the weft yarn prior to insertion continuously or at intervals with a yarn thickness detector;

(b) controlling the pressure of ejection of a fluid such as air so as to be optimum for inserting the weft yarn with an ejection pressure control mechanism based on a result of detection of the thickness of the weft yarn; and (c) ejecting the fluid through a nozzle member under the controlled pressure for inserting the weft yarn through a warp shed.

2. A method according to claim 1, wherein the thickness of the weft yarn is detected continuously during weft inserting operation, and the pressure of ejection of the fluid is controlled on the basis of a result of such continuous detection.

3. A method according to claim 1, wherein the thickness of the weft yarn is detected at intervals during weft inserting operation, and the pressure of ejection of the fluid in following weft inserting operation is controlled on the basis of the statistical analysis of a result of such periodic detection.

4. A method according to claim 1, wherein said yarn thickness detector is arranged to convert the result of detection of the thickness of the weft yarn into an electric signal, and transmit the electric signal to said ejection pressure control mechanism.

5. A method according to claim 4, wherein said yarn thickness detector is positioned between a weft tensioning unit and a weft length measuring unit.

6. A method according to claim 4, wherein said yarn thickness detector is positioned between a weft length measuring unit and a weft yarn storage unit.

7. A method according to claim 4, wherein said ejection pressure control mechanism comprises an ejection pressure control device for issuing a command in response to the electric signal delivered from said yarn thickness detector, and at least one pressure regulator actuatable by the command from said ejection pressure control device for controlling and supplying the fluid from a fluid source to said nozzle member.

8. A method according to claim 7, wherein said ejection pressure control device is arranged to calculate the mean value of electric signals corresponding to the mean value of thicknesses of the weft yarn to be inserted in one cycle of weft insertion in response to such electric signals, and to issue said command indicative of the calculated mean value.

9. A method according to claim 7, wherein said ejection pressure control device is arranged to issue said command based on a maximum value and/or a minimum value of thicknesses of the weft yarn to be inserted in one cycle of weft insertion.

10. A method according to claim 7, wherein said pressure regulator including at least one reservoir tank connected to said pressure regulator for being supplied with the fluid from said pressure regulator and storing the fluid under a constant internal pressure at all times, and at least one solenoid-operated valve coupled with said reservoir tank and actuatable in response to the command from said ejection pressure control device for supplying the fluid from said reservoir tank to said nozzle member.

11. A method according to claim 10, wherein said reservoir tank includes a second reservoir tank having an internal pressure optimum for inserting a weft yarn having a normal thickness, a third reservoir tank having an internal pressure lower than the internal pressure of said second reservoir tank and optimum for inserting a weft yarn having a thickness smaller than said normal thickness, and a first reservoir tank having an internal pressure higher than the internal pressure of said second reservoir tank and optimum for inserting a weft yarn having a thickness larger than said normal thickness, said pressure regulator includes first, second and third pressure regulators held in fluid communication with said first, second and third reservoir tanks, respectively, and said solenoid-operated valve includes first, second and third solenoid-operated valves held in fluid communication with said first, second and third reservoir tanks, respectively.

* * * * *